United States Patent [19]

Kinghorn et al.

[11] 4,116,358

[45] Sep. 26, 1978

[54] WEATHER AND VAPOR SEAL FOR STORAGE TANK

[75] Inventors: John S. Kinghorn; Robert B. Wagoner, both of Houston; Alfred J. Turala, Seabrook, all of Tex.

[73] Assignee: Aerojet-General Corporation, El Monte, Calif.

[21] Appl. No.: 797,465

[22] Filed: May 16, 1977

[51] Int. Cl.[2] ..... B65D 87/20

[52] U.S. Cl. ..... 220/222

[58] Field of Search ..... 220/216–227

[56] References Cited

U.S. PATENT DOCUMENTS

| | | | |
|---|---|---|---|
| 1,463,268 | 7/1923 | Huff | 220/222 |
| 1,698,158 | 1/1929 | Glass | 220/222 |
| 2,329,966 | 9/1943 | Wiggins | 220/224 |
| 2,436,942 | 3/1948 | Shanor | 220/224 |
| 2,754,026 | 7/1956 | Wiggins | 220/224 |
| 2,914,212 | 11/1959 | Fino | 220/222 |
| 2,997,200 | 8/1961 | Giannini et al. | 220/222 |
| 3,043,468 | 7/1962 | Horner, Jr. | 220/226 |
| 3,119,511 | 1/1964 | Giannini | 220/226 |
| 3,338,454 | 8/1967 | Nelson | 220/224 |
| 3,900,127 | 8/1975 | Schwarz | 220/216 |

*Primary Examiner*—Stephen Marcus

*Attorney, Agent, or Firm*—Cook, Wetzel & Egan, Ltd.

[57] ABSTRACT

A seal is described herein for covering the rim space of a cylindrical tank container having a floating roof laterally spaced from the interior wall of the tank. The seal includes a flexible shield, preferably of metal, having one end rigidly connected to an upper portion of the floating roof and a second end extending outwardly from the roof and toward the interior wall of the tank. A flexible wiper blade is connected to the extending end of the shield for engaging the inner surface of the tank wall. The combined shield and wiper blade extend from the upper portion of the roof toward the interior tank wall at an acute angle A with respect to the horizontal, with the length of the shield being greater than the average rim space dimension divided by the cosine of the angle A. Covering the shield is a flexible, light-reflective, gas impermeable fabric which extends continuously around the perimeter of the roof.

15 Claims, 9 Drawing Figures

WEATHER AND VAPOR SEAL FOR STORAGE TANK

BACKGROUND OF THE INVENTION

This invention is generally related to seals for use in storage tanks and is particularly directed to a combination weather and vapor seal for covering the rim space between the inner wall of a storage tank and its floating roof.

In the storage of petroleum products such as gasoline, it is conventional to store the product in a cylindrical tank whose roof floats on the contained product. As the level of the product rises and falls, the floating roof undergoes a corresponding movement.

To enable the roof to rise and fall freely with the level of the contained product, the diameter of the roof is made smaller than the diameter of the tank so that the roof is actually situated within and spaced from the walls of the tank. The space which surrounds the roof and which separates it from the walls of the tank is commonly known as the "rim space". Unless the rim space is otherwise covered, the product contained in the tank is exposed to the atmosphere wherever the rim space exists. As a result of such exposure, the product may be contaminated by rainfall and other airborne contaminants. In addition, vapors from the contained product may escape through an uncovered rim space, thereby depleting the product and presenting a possibly hazardous condition.

In the past, many efforts have been made to provide a seal for the rim space which will effectively seal in vapors and seal out atmospheric contaminants. Such a seal typically extends between the inner tank wall and the top of the roof and is mounted so as to ride up and down with the movement of the roof. One of the most practical of the prior art seals has included a flexible metal shield which is mounted to the upper perimeter of the roof and which extends diagonally upwardly toward the inner wall of the tank. A rubber wiper blade has been mounted on the end of the shield for engaging and pressing against the inner wall of the tank.

Although the above-described seal has been found to be an improvement over other seals, it has also been found to be deficient in two regards. Specifically, when such a seal has been used with storage tanks having a variable rim space dimension, effective contact between the wiper blade and the inner tank wall is lost when the roof moves laterally so as to increase the rim space on one side of the roof and decrease the rim space on an opposed side of the roof. On the side of the roof where the rim space increases, either insufficient contact or no contact may result between the tank wall and the wiper blade. In addition, when the wiper blade makes minimum contact with the tank wall and rises upwardly with the roof, engagement between the wiper blade and a protruding weld seam in the tank wall can cause the contacting edge of the wiper blade to momentarily stop at the weld seam while the remainder of the seal continues upwardly. As a result, the metal shield may be bent downwardly and be permanently deformed.

A second deficiency found to exist in the above-described seal is that vapors from the contained product may escape to the atmosphere even when the wiper blade is making firm contact with the wall of the tank. Such vapor loss may occur because of the fact that the metal shield is not a unitary continuous piece that extends completely around the rim space. Rather, it is made of a plurality of adjacent shield sections which lap or abut each other. The interfaces between adjacent sections of the shield thus provide escape routes for the vapor to the atmosphere. Even though such vapor loss is not great, the tendency of environmental standards is to prohibit even small vapor losses.

An additional problem with the above-described seal is that it permits the temperature within the rim space to reach an undesirably high level, thereby accelerating the generation of vapors from the product contained in the tank. As a consequence of the accelerated generation of vapor, more of the product may be depleted and more vapor may escape.

Accordingly, it is an object of this invention to provide an improved seal for the rim space of a storage tank which is not subject to the problems described above.

It is a more specific object of this invention to provide a rim space seal capable of making effective sealing contact between a wiper blade and an interior tank wall under conditions of varying rim space dimensions.

It is another object of this invention to provide a rim space seal which tends to maintain the temperature within the rim space at a relatively low level.

These and other objects of the invention are more particularly set forth in the following detailed description and in the accompanying drawings of which:

Figure 2:
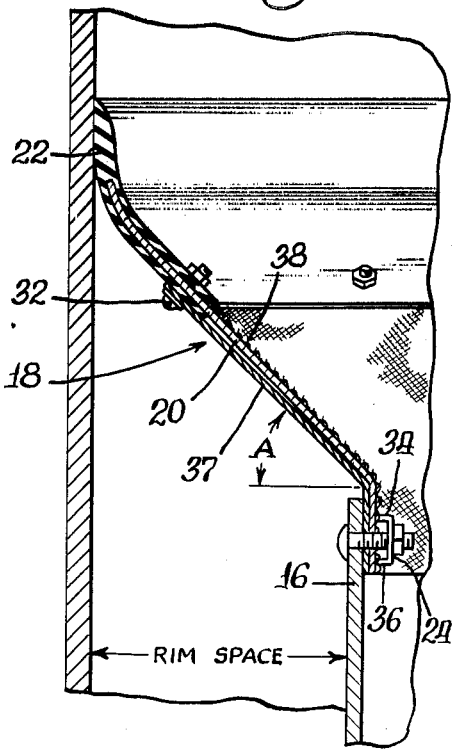
FIG. 2 is a sectional view showing further details of the seal illustrated in FIG. 1.
Figure 4:
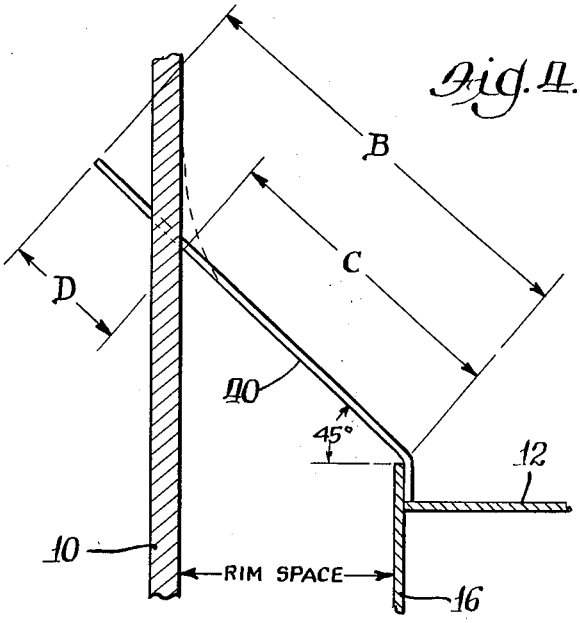
Figure 5:
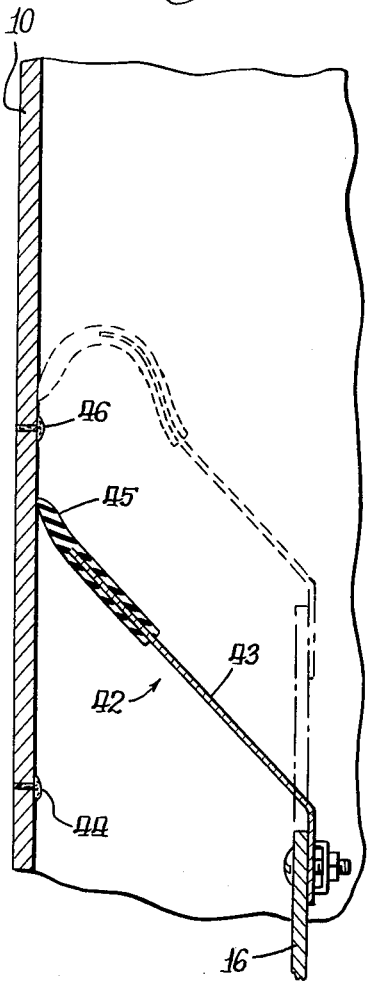
Figure 6:
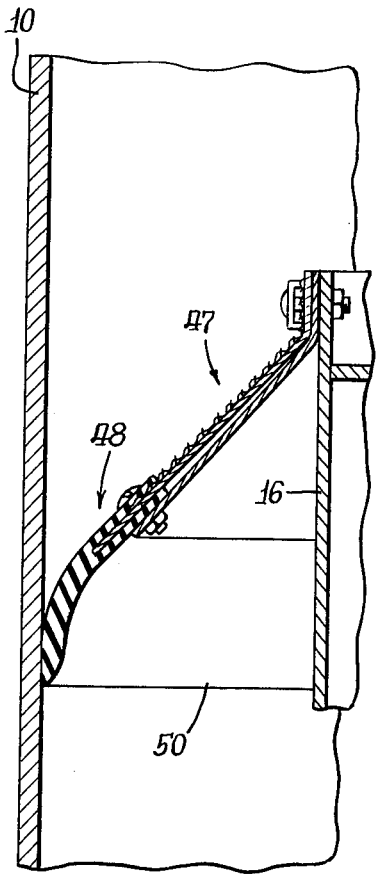
Figure 7:
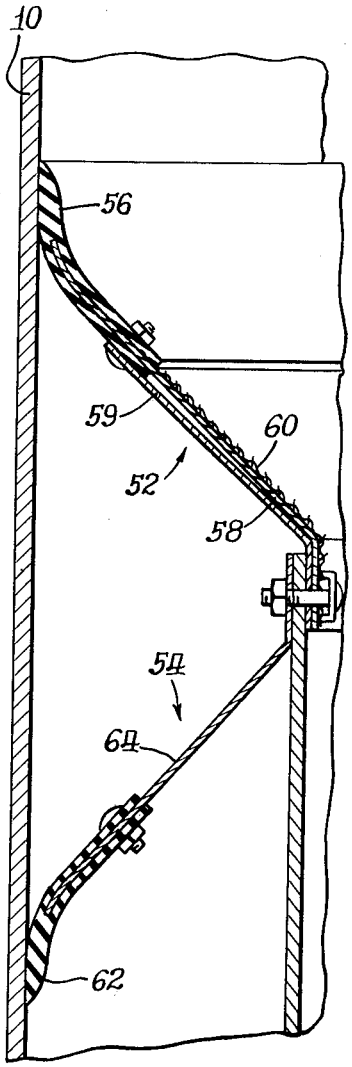
Figure 8:
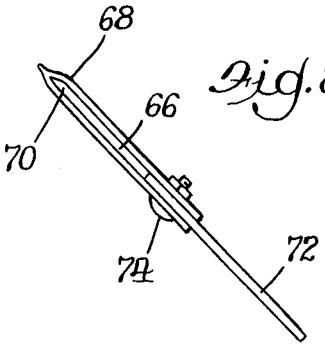
Figure 9:
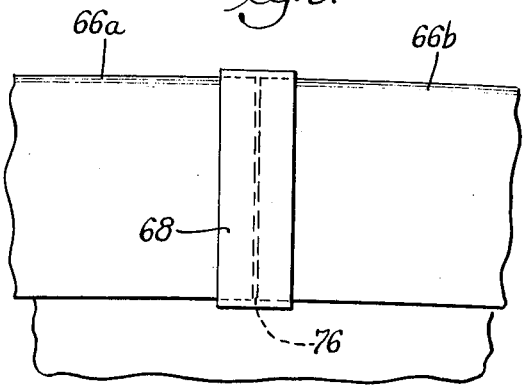

FIG. 4 schematically illustrates various dimensions of a portion of the improved seal for use in explaining design criteria for use in the construction of the seal;

FIG. 5 illustrates a problem encountered by a seal not constructed in accordance with the criteria set forth herein;

FIG. 6 illustrates an alternate embodiment of the seal shown in FIG. 2;

FIG. 7 illustrates another embodiment of the seal described herein;

FIG. 8 illustrates a portion of the seal described herein with a conductive and sealing sheath covering the wiper blade; and FIG. 9 illustrates the preferred location of the sheath shown in FIG. 7.

DESCRIPTION OF THE PREFERRED EMBODIMENT

Broadly stated, one embodiment of the seal described herein includes a flexible shield having one end rigidly connected to an upper portion of a floating tank roof and a second end extending upwardly and outwardly toward an interior wall of the tank. A flexible wiper blade is connected to the extending end of the shield for engaging the inner surface of the tank wall. The combined shield and wiper blade extend from the upper portion of the roof to the interior tank wall at an acute angle A with respect to the horizontal, with the length of the shield being greater than the average rim space dimension divided by the cosine of the angle A. By thus dimensioning the shield, effective sealing is provided between the wiper blade and the interior wall of the tank even when the rim space varies with lateral motion of the floating roof.

In a preferred embodiment the shield is dimensioned to have a length at least 1.5 times greater thn the average rim space divided by the cosine of the angle A, wherein the average rim space is defined by one half the sum of the maximum and minimum rim spacing around the perimeter of the roof. In addition, a flexible, light-reflective, gas impermeable fabric covers the shield continuously around the perimeter of the roof to further inhibit the loss of vapors from the interior of the tank to the atmosphere and to reduce the temperature within the tank.

Figure 1:
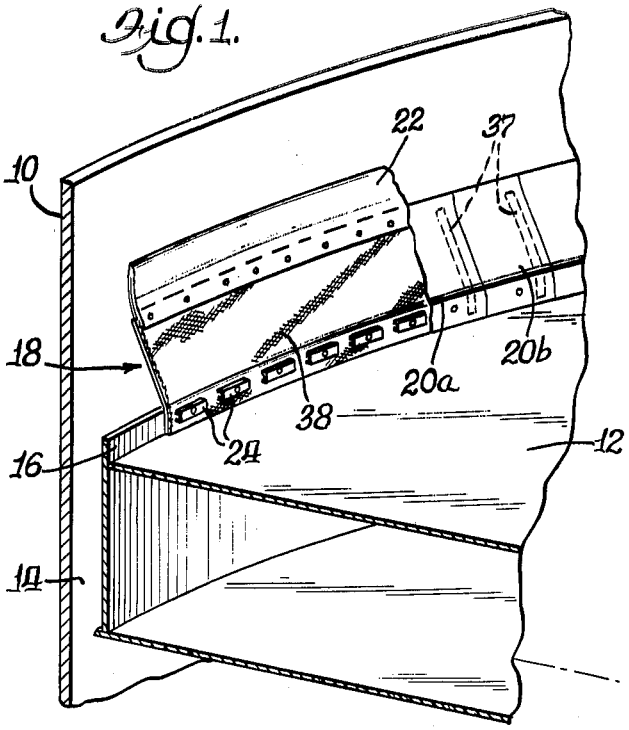
FIG. 1 is a perspective view, partly broken away, which illustrates a rim space seal in accordance with the present invention, as installed in a conventional storage tank.

Referring now to FIGS. 1 and 2, there is shown a fragmentary view of the interior of a conventional storage tank for containing petroleum products and the like. The storage tank includes a vertically extending, cylindrical side wall 10 and a floating roof 12 which is spaced from the wall 10 by a rim space 14. At the top of the roof 12 there is a vertically extending rim plate 16 which extends substantially parallel to the side wall 10 and upon which a rim space seal 18 is mounted. Although it is not shown as such, the seal 18 extends completely around the outer perimeter of the rim plate 16 and entirely covers the annular rim space 14.

The seal 18 as shown in FIG. 2 constitutes a combined weathershield and vapor seal for sealing out atmospheric contaminants and simultaneously sealing in vapors from the product contained in the tank. The major components of the weathershield include a flexible shield 20, preferably of metal, and a flexible wiper blade 22, preferably of rubber. The shield 20 is connected to an upper portion of the rim plate 16 by a channel bracket 24 which presses the shield 20 firmly against the rim plate 16. The shield 20 is bent at the top end of the rim plate 16 so as to extend upwardly at an angle oblique to the horizontal toward the interior tank wall 10.

Figure 3:
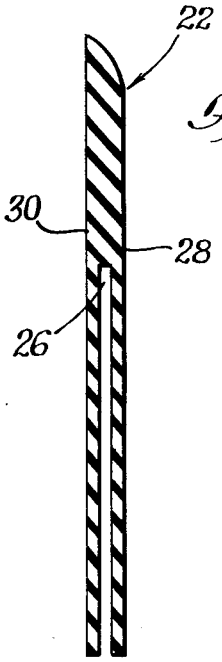
FIG. 3 illustrates a wiper blade which is a component of the seal shown in FIGS. 2 and 3.

In order to mate the shield 20 with the wiper blade 22, the wiper blade 22 includes a slot 26 spaced between and running parallel to the upper surface 28 and the lower surface 30 of the wiper blade 22 (see FIG. 3).

To engage the wiper blade 22 with the shield 20, the latter is inserted into the slot 26 and is permanently coupled to the wiper blade 22 by means of a conventional fastener 32 which extends through the wiper blade 22 and the shield 20.

Preferably, the shield 20 is made of galvanized steel and is of a thickness which will permit it to flex as shown while remaining resilient for urging the wiper blade 22 into pressing engagement with the tank wall 10 so as to create a tight seal between the wiper blade 22 and the wall 10. The thickness of the shield 20 will vary according to the dimensions of the rim space but is typically approximately 20 gauge for rim spaces of from 6 to 10 inches and 16 gauge for rim spaces of from 10 to 14 inches.

To urge the wiper blade 22 into effective sealing engagement with the wall 10, it is preferred that the shield 20 be coupled to the rim plate 16 so as to press a substantial portion of the shield 20 against the rim plate 16. The channel bracket 24 accomplishes this purpose by virtue of having a pair of legs 34 and 36 which are spaced apart relative to each other and which extend horizontally for pressing a substantial area of the shield 20 against the interior surface of the rim plate 16 as shown.

For ease of assembling the seal thus far described, the wiper blade 22 may be cut into lengths of 12 feet each, for example, with adjacent lengths of the wiper blade placed in abutting relationship. The shield 20, however, is typically constructed of a plurality of smaller adjacent sections **20*a* and 20*b* such as shown in FIG. 1, each such section having a width of approximately 2 feet. Thus 6 sections of the shield 20 would be inserted into the slot 26 in a single length of the wiper blade 22**.

Adjacent sections of the shield 20 may overlap or abut each other, but the overlapping relationship is preferred in order to permit adjacent sections to move transversely.

As shown in FIGS. 1 and 2, the seal 18 may also include a plurality of resilient metal buffer strips 37 which are fastened to the underside of each section **20*a*, 20*b*, etc. of the shield. The strips 37 are held to the shield sections 20*a*, 20*b*, etc. at one end by the fasteners 32 and at their opposed ends by the brackets 24. Each strip 37 is dimensioned to extend from the connection between a shield section and the roof to beyond and beneath the point where the shield section mates with the slot 26 in the wiper blade 22. Accordingly, each strip 37 covers the bottom interface between the shield 20 and the wiper blade 22 as shown in FIG. 2**.

The primary function of the strips 37 is to ensure that the seal 18 does not hang up on the top of the wall 10 when the level of the product within the tank causes the roof to rise to such an extent that the wiper blade 22 protrudes above the top edge of the wall 10 and the roof subsequently descends to a lower level. Assuming that the wiper blade 22 is protruding above and beyond the top of the wall 10, during the subsequent descent of the roof the strips 37 will bear on the top of the tank wall 10 and cover the interface between the shield 20 and the wiper blade 22, thereby preventing that interface from engaging and being held by the top of the wall 10.

As pointed out above, a prior weathershield also has a wiper blade connected to a shield and extends from the rim plate of a floating roof upwardly to press against the interior of a tank wall. However, construction of such prior devices has lead to difficulties in maintaining an effective seal between the wiper blade and the tank wall and in inhibiting vapors from escaping between two adjacent sections of the shield 20, such as between sections **20*a* and 20*b***.

To limit the escape of vapor fumes from the rim space into the atmosphere, the improved seal 18, as illustrated in FIGS. 1 and 2, includes a vapor seal overlying all sections of shield 20, which vapor seal is unitary in construction and extends completely around the annular rim space. In the preferred embodiment, the vapor shield comprises a flexible, gas impermeable fabric 38 which overlies the shield 20 and covers the interfaces between adjacent sections of the shield 20. The fabric 38 is held in place by inserting it into the slot 26 in the wiper blade 22 and over the shield 20. Fastener 32 passes through the wiper blade 22 and shield 20 and the fabric 38. The opposite end of the fabric 38 is held between the channel bracket 24 and the shield 20. With the fabric 38 thus secured, vapors within the rim space cannot escape to the atmosphere through the interfaces between sections of the shield 20 or between the wiper blade 22 and the tank wall 10 as long as an effective seal is maintained between the wall 10 and the wiper blade 22.

To limit the temperature within the tank, the surface of the fabric 38 which faces the atmosphere is made light-reflective, preferably by constructing the fabric 38 of a nylon fiber center sandwiched between layers of white chlorosulfonated polyethylene. Such a fabric is obtainable from Reeves Brothers, Vulcan Division, Buena Vista, Va. and is sold under the trademark HYPALAN. The use of the fabric 38 has been found to reduce the rim space temperature by approximately 30° F.

As pointed out above, prior seals did not always maintain effective sealing contact between the wiper blade and the tank wall, largely because of the fact that the dimensions of the seal were not properly related to the varying dimensions of the rim space 10 in order to accommodate a widely variable rim space. For example, a particular seal may be designed to cover a rim space whose average dimension is 8 inches. It has been found, however, that frequently the roof will move laterally so that the rim space on one side of the roof will be reduced to 4 inches and the rim space on the opposed side of the roof will be enlarged to 12 inches. With such variance, the average rim space is still 8 inches, but a seal which is designed for a rim space of 8 inches will likely lose effective sealing contact between the wiper blade and the wall of the tank when such excessive movement of the roof occurs.

To insure that good sealing contact is maintained between the wiper blade 22 and the tank wall 10, the length of the shield 20 should be greater than the average rim space dimension divided by the cosine of the angle A which the weathershield makes with the horizontal, as shown in FIG. 2. As will be explained below, it is preferred that the over-all length of the shield in the direction of its extension toward the wall be at least 1½ times greater than the average rim space dimension divided by the cosine of the angle A.

Referring now to FIG. 4, there is shown a schematic representation of a shield 40, it being understood that the latter, although shown schematically, is similar to the shield 20 of FIG. 2. Further, the tank wall 10 and the rim plate 16 are shown as being separated by their maximum rim space, 12 inches for example, in a tank whose average rim space is designed to be 8 inches. Under these conditions, the shield 40 will extend from the rim plate 16 at an angle A (shown herein as 45°) up to the wall 10 (dimension C) and, if unobstructed by the wall 10, would extend outwardly thereof by the dimension D. The desired length of the weathershield is dimension B, the combination of dimensions C and D.

For the worst case condition illustrated, the dimension D should be from 1 to 4 inches and preferably approximately 1½ inches. In computing the dimension C, the average rim space is first determined by measuring the maximum rim space and the minimum rim space around the perimeter of the roof. The maximum and minimum rim space dimensions are then added together and divided by 2 to arrive at an average rim space dimension. The average rim space dimension is then multiplied by 1.5 and the result divided by the cosine of the angle A, thereby giving dimension C. Dimensions C and D are then added together to arrive at dimension B, the desired length of the shield. More compactly, dimension $B = [1.5 \times \text{average rim space}) \div \text{cosine } A] + D$. A shield so dimensioned will, even in the case where the rim space is at its maximum value, extend as shown in the dashed lines and press a wiper blade into effective sealing engagement with the wall 10.

Multiplying the average rim space by the factor of 1.5 would not be necessary, of course, if the roof were maintained in a centered position within the tank. However, it has been observed that roofs tend to move off center so that there is more rim space on one side of the roof than the other, so that a seal whose construction is based only on the designed average rim space dimension tends to lose its sealing effect on that side of the roof where the greatest rim space occurs.

The design criteria set forth above not only insures that an adequate seal is provided around the rim space, but, by virtue of the fact that the shield 40 will most forcefully press a wiper blade against the wall 10 where the minimum rim space occurs, the roof will tend to be pushed away from the wall at the point of minimum rim space so that the rim space will approach its designed average dimension nearly everywhere around the roof.

Not only does a seal constructed in accordance with the criteria set forth above provide an effective seal between the wiper blade and the tank wall when the dimension of the rim space varies, and in addition provide a centering force for maintaining the roof in the center of the tank, it also avoids a problem associated with prior seals not heretofore discussed. The latter aspect is described with reference to FIG. 5 which shows a prior weathershield 42 comprising a shield 43 and a wiper blade 45, dimension B of the shield 43 having been calculated only in accordance with the designed average rim space dimension, 8 inches, for example. The situation illustrated occurs where the rim plate 16 is spaced from the tank wall 10 by a distance greater than the designed average rim space, 12 inches, for example. Under the conditions shown, the wiper blade 45 is just barely making contact with the tank wall 10 and is providing little, if any, sealing effect. Because the wiper blade 45 is not pressed against the wall 10 so as to be deflected upwardly, it is prone to be deflected downwardly upon encountering a protuberance on the inside of the tank wall 10. For example, a wall 10 may include weld seams 44 and 46 which protrude somewhat into the interior of the tank. Under the conditions shown, if the roof rises the wiper blade 45 will encounter the weld seam 46 and will be deflected downwardly, as shown in dashed lines, as the roof continues to rise. A large rise of the roof may result in the shield 43 also being deflected downwardly as shown. Subsequent downward movement of the roof may enable the wiper blade 45 to assume its normal form but the shield 43 may be permanently deformed, at least to the extent that its resiliency is lost. Such condition does not occur when the shield 43 is designed in accordance with the criteria set forth above wherein maximum and minimum rim space measurements are made to determine an average rim space and the average rim space is multiplied by approximately 1.5 in the calculation of the dimension B.

Referring now to FIG. 6, there is shown another embodiment of this invention wherein a seal 47 constructed in accordance with the criteria set forth above is connected to the rim plate 16 so as to be inclined downwardly from the horizontal towards the tank wall 10 so as to form a trough 48 between the rim plate 16 and the wall 10. The advantage of this embodiment is that, should a fire start in the rim space 50, the fire may be extinguished by applying foam in the trough 48 so as to completely cover the seal 47. The covering of the seal 47 with foam will effectively cut off any fire in the rim space from a source of oxygen, whereupon the fire will eventually consume the available oxygen in the rim space 50 and become extinguished.

An alternate embodiment of this invention is shown in FIG. 7 wherein the rim space is sealed by an upper seal 52 and a lower seal 54. The upper seal 52 is preferably identical to the seal 18 of FIG. 2; that is, it includes a wiper blade 56, a shield 58, a buffer strip 59, and a fabric covering 60. The lower shield 54 is similar to the upper shield 52 in that it includes a wiper blade 62 and a shield 64, but does not necessarily include a fabric covering over the shield 64 or a buffer strip. The upper seal 52 will, of course, extend completely around the rim space 50. However, the lower seal 54 may or may not extend completely around the rim space 50. For example, under circumstances where the escape of even a small amount of vapor from the rim space 50 is prohibited, the lower seal 54 will extend completely around the rim space 50 so that, in effect, the rim space is sealed by a double seal.

Where the upper seal 52 provides adequate vapor sealing for the circumstances, the lower shield 54 need not be continuous but may include a plurality of similar and equally spaced seal sections around the rim space 54. For example, four seal sections 54 may be spaced at 90° angles around the rim space 50 with gaps between the individual seal sections. In this arrangement, the lower seal sections 54 provide no vapor sealing effect but they impose on the roof additional centering forces for centering the roof with respect to the walls of the tank 10.

Referring now to FIG. 8, there is shown schematically a further embodiment whereby any electrical charge which develops on the wall of the tank may be drained off to the roof of the tank, or vice versa, to inhibit development of a voltage potential between the wall of the tank and its roof. To effect such charge drainage, a wiper blade 66 is covered with a metal sheath 68 of electrically conductive material. The sheath 68 extends from the wiper end 70 of the wiper blade 66 and continues along the upper and lower surfaces of the wiper blade 66 to a point where the wiper blade 66 joins the metal shield 72. At that point an electrically conductive fastener 74 connects the sheath 68 to the wiper blade 66 and to the metal shield 72, thereby providing a path for electrical charges to flow from the tank wall, through the sheath 68 and the fastener 74 to the metal shield 72. With an appropriate electrical connection made between the metal shield 72 and the roof, a complete path for the flow of charge between the roof and the wall of the tank is provided.

In addition to providing a drain for excess charge, the sheath 68 may also help seal the interface between adjacent sections of wiper blades. For example, referring to FIG. 9, the wiper blade 66 is shown as comprising sections **66*a* and 66*b* which abut at their interface 76. The sheath 68 is wrapped around the sections 66*a* and 66*b* at their interface 76, thereby covering the interface 76 to provide additional protection against the loss of vapors and the admission of atmospheric contaminants through the interface 76. Similar sheaths 68** may be positioned at each interface between abutting sections of wiper blades to enhance the sealing effect of the wiper blades and to provide a path for the drain of electrical charges which may develop on the roof or the wall of the tank.

The various embodiments described above provide rim space seals which maintain their ability to contain vapors and to exclude atmospheric contaminants over a wide range of rim space dimensions. The light-reflective fabric is particularly advantageous in that it further contains vapors within the rim space while at the same time reducing the temperature within the rim space to limit the generation of vapor. Also, the embodiments described herein may be used alone or covering a primary seal of foam, for example, in order to provide additional sealing protection.

The specific illustrated construction of the various embodiments is, of course, subject to many variations and alterations which will be obvious to one skilled in the art. Accordingly, the appended claims are intended to embrace all such variations and alterations which fall within the true spirit and scope of the invention.

What is claimed is:

1. In a storage tank having a cylindrical wall and a floating roof spaced from the wall by a rim space having a dimension between the wall and the roof which varies about an average dimension, a combined weather and vapor seal for covering the rim space, comprising:

a flexible shield comprising a plurality of adjacent flexible shield sections disposed around the perimeter of the roof and substantially completely covering the rim space, each such shield section having a first end rigidly connected to an upper portion of the floating roof and a second end extending toward the wall of the storage tank;

flexible means supported from said shield for engaging the inner surface of the wall, the combination of said shield and said flexible means disposed to extend from the upper portion of the roof to the wall at an acute angle A with respect to the horizontal, and each shield section having, when unflexed, a substantially linear dimension in the direction of its intended extension from the roof toward the wall which is greater than the average rim space dimension divided by the cosine of the angle A, such that, upon installation in the tank, each shield section flexes along its linear dimension to urge said flexible means against the tank wall; and vapor seal means associated with said shield sections for preventing the escape of vapors from within the tank and between the shield sections, whereby the dimensioning of the shield ensures that the flexible means remains firmly pressed against the tank wall as the rim space varies so as to inhibit the release of vapors from the interior of the tank and to protect the interior of the tank from atmospheric contaminants, and said vapor seal means further inhibits the loss of vapors from the interior of the tank to the atmosphere.

2. A seal as set forth in claim 1 wherein said flexible means comprises a wiper blade and wherein the combination of said shield and said wiper blade is inclined upwardly from the horizontal toward the wall of the tank.

3. A seal as set forth in claim 1 wherein said flexible means comprises a wiper blade and wherein the combination of said shield and the wiper blade is inclined downwardly from the horizontal toward the wall of the tank so as to form a trough between the wall of the tank and the roof.

4. A seal as set forth in claim 2 wherein the combination of said upwardly inclined shield, said wiper blade and said vapor seal constitutes a first seal, and further including a second seal comprising a second flexible shield disposed beneath said first seal and having a first end rigidly connected to an upper portion of the floating roof and a second end extending downwardly toward the wall of the storage tank, and a second flexible wiper blade having a wiper end for engaging the inner surface of the wall and an opposed end coupled to the second end of said second shield.

5. A seal as set forth in claim 4 wherein said first seal extends around the entire perimeter of the roof and said second seal includes a plurality of similar and equally spaced sections for imposing on said roof additional centering forces for centering the roof with respect to the walls of the tank.

6. A seal as set forth in claim 1 wherein said shield is metal, said flexible means comprises a wiper blade having a wiper end for engaging the inner surface of the wall and an opposed end coupled to the second ends of said shield sections, and further including at least one electrically conductive sheath covering a portion of the wiper end of said wiper blade and extending from the wiper end of said blade to said shield, said sheath being connected to said shield and said shield being connected to the roof so as to provide an electrical path between the roof and the wall of the tank for draining electrical charges therebetween.

7. A seal as set forth in claim 1 wherein said vapor seal comprises a flexible, gas impermeable fabric covering said shield sections.

8. A seal as set forth in claim 7 wherein said fabric has a light-reflective surface.

9. A seal as set forth in claim 8 wherein said fabric is a continuous fabric piece covering said shield sections to inhibit the loss of vapors from within the tank between said shield sections.

10. A seal as set forth in claim 9 wherein said shield is inclined upwardly from the horizontal toward the wall of the tank, wherein said flexible means comprises a wiper blade having an upwardly facing top surface, a downwardly facing lower surface, and a slot between the top and bottom surfaces of the wiper blade for receiving the shield sections, and further including a plurality of resilient metal strips, one such strip fastened to the underside of each shield section and dimensioned to extend from the connection between a shield section and the roof to beyond and beneath the point where the shield section mates with the slot in said wiper blade, whereby after elevation of the roof to a point where said wiper blade extends above the wall of the tank, said resilient strips will bear on the top of the tank wall when the roof descends so as to cover the interface between the shield and the wiper blade and prevent the interface from being held by the top of the tank wall.

11. In a storage tank having a cylindrical wall and a floating roof spaced from the wall by a rim space having a dimension between the wall and the roof which varies about an average dimension, a combined weather and vapor seal for covering the rim space, comprising:

a flexible shield having a first end rigidly connected to an upper portion of the floating roof and a second end extending toward the wall of the storage tank;

a flexible wiper blade having a wiper end for engaging the inner surface of the wall and an opposed end coupled to the second end of said shield, the combination of said shield and said wiper blade disposed to extend from the upper portion of the roof to the wall at an acute angle A with respect to the horizontal, the length of the shield in the direction of its extension toward the wall being at least 1.5 times greater than the average rim space divided by the cosine of the angle A; and a flexible, gas impermeable, fabric covering said shield, whereby the dimensioning of the shield ensures that the wiper blade remains firmly pressed against the tank wall as the rim space varies so as to inhibit the release of vapors from the interior of the tank and to protect the interior of the tank from atmospheric contaminants, and said fabric further inhibits the loss of vapors from the interior of the tank to the atmosphere.

12. A seal as set forth in claim 11 wherein the length of the shield is from one to four inches greater than 1.5 times the average rim space dimension divided by the cosine of the angle A.

13. In a storage tank having a cylindrical wall and a floating roof spaced from the wall by a rim space having a dimension between the wall and the roof which varies about an average dimension, a combined weather and vapor seal for covering the rim space, comprising:

a flexible shield having a first end rigidly connected to an upper portion of the floating roof and a second end extending upwardly and toward the wall of the storage tank;

a flexible wiper blade having a wiper end for engaging the inner surface of the wall and an opposed end coupled to the second end of said shield, said shield extending from the upper portion of the roof upwardly toward the wall at an oblique angle A with respect to the horizontal, the length of the shield in the direction of its extension toward the wall being from one to four inches greater than 1.5 times the average rim space dimension divided by the cosine of the angle A, and means associated with said shield for preventing the escape of vapors from the tank, through the shield, and into the atmosphere.

14. A seal as set forth in claim 13 wherein said means for preventing escape of vapors includes a flexible, gas impermeable fabric covering said shield.

15. A seal as set forth in claim 14 wherein said fabric is light reflective.

* * * * *

REEXAMINATION CERTIFICATE (141st)

United States Patent [19] [11] B1 4,116,358

Kinghorn et al. [45] Certificate Issued Nov. 29, 1983

[54] WEATHER AND VAPOR SEAL FOR STORAGE TANK

[75] Inventors: John S. Kinghorn; Robert B. Wagoner, both of Houston; Alfred J. Turala, Seabrook, all of Tex.

[73] Assignee: Graver Tank & Mfg. Co., Inc., Pasadena, Tex.

Reexamination Request:
No. 90/000,214, Jun. 7, 1982

Reexamination Certificate for:

| | |
|---|---|
| Patent No.: | **4,116,358** |
| Issued: | **Sep. 26, 1978** |
| Appl. No.: | **797,465** |
| Filed: | **May 16, 1977** |

[51] Int. Cl.[3] ..... B65D 88/42; B65D 88/46

[52] U.S. Cl. ..... 220/222; 220/224; 361/212; 361/215

[58] Field of Search ..... 220/216–227; 361/212, 215

[56] References Cited

U.S. PATENT DOCUMENTS

| | | | |
|---|---|---|---|
| 1,463,268 | 7/1923 | Huff | 220/222 |
| 1,698,158 | 1/1929 | Glass | 220/222 |
| 1,879,572 | 9/1932 | Speegle . | |
| 1,986,869 | 1/1935 | Welp . | |
| 1,992,221 | 2/1935 | Kramer . | |
| 2,180,587 | 11/1939 | Hammeren . | |
| 2,329,966 | 9/1943 | Wiggins | 220/224 |
| 2,354,629 | 7/1944 | Wiggins . | |
| 2,436,942 | 3/1948 | Shanov | 220/224 |
| 2,568,728 | 9/1951 | Goldsby . | |
| 2,754,026 | 7/1956 | Wiggins | 220/224 |
| 2,897,998 | 8/1959 | Ulm . | |
| 2,914,212 | 11/1959 | Fino | 220/222 |
| 2,981,438 | 4/1961 | Heisterberg . | |
| 2,997,200 | 8/1961 | Giannini | 220/222 |
| 3,043,468 | 7/1962 | Horner, Jr. | 220/226 |
| 3,119,511 | 1/1964 | Giannini | 220/226 |
| 3,204,809 | 9/1965 | Cadwell . | |
| 3,338,454 | 8/1967 | Nelson | 220/224 |
| 3,372,831 | 3/1968 | Daniels . | |
| 3,373,891 | 3/1968 | Kidd . | |
| 3,583,594 | 6/1971 | Belanger . | |
| 3,735,891 | 5/1973 | Nishkian . | |
| 3,900,127 | 8/1975 | Schwarz | 220/216 |
| 3,942,674 | 3/1976 | Nelson . | |
| 4,036,395 | 7/1977 | Tuckey . | |
| 4,099,644 | 7/1978 | Nuttall . | |

FOREIGN PATENT DOCUMENTS

| | | |
|---|---|---|
| 254342 | 3/1961 | Australia . |
| 1024434 | 11/1955 | Fed. Rep. of Germany . |
| 1196283 | 11/1959 | France . |
| 468711 | 6/1936 | United Kingdom . |

*Primary Examiner*—Alan N. Shoap

[57] ABSTRACT

A seal is described herein for covering the rim space of a cylindrical tank container having a floating roof laterally spaced from the interior wall of the tank. The seal includes a flexible shield, preferably of metal, having one end rigidly connected to an upper portion of the floating roof and a second end extending outwardly from the roof and toward the interior wall of the tank. A flexible wiper blade is connected to the extending end of the shield for engaging the inner surface of the tank wall. The combined shield and wiper blade extend from the upper portion of the roof toward the interior tank wall at an acute angle A with respect to the horizontal, with the length of the shield being greater than the average rim space dimension divided by the cosine of the angle A. Covering the shield is a flexible, light-reflective, gas impermeable fabric which extends continuously around the perimeter of the roof.

REEXAMINATION CERTIFICATE ISSUED UNDER 35 U.S.C. 307.

WEATHER AND VAPOR SEAL FOR STORAGE TANK

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 33–34:
FIG. 3 illustrates a wiper blade which is a component of the seal shown in FIGS. [2 and 3] *1 and 2;*

Column 2, lines 48–49:
FIG. 9 illustrates the preferred location of the sheath shown in FIG. [7] *8.*

AS A RESULT OF REEXAMINATION, IT HAS BEEN DETERMINED THAT:

Claims 1–9 and 11–15 having been finally determined to be unpatentable, are cancelled.

Claim 10 is determined to be patentable as amended:

New claim 16 is added and determined to be patentable.

10. [A] *In a storage tank having a cylindrical wall and a floating roof spaced from the wall by a rim space having a dimension between the wall and the roof which varies about an average dimension, a combined weather and vapor* seal [as set forth in claim 9] *for covering the rim space, comprising:*

*a flexible shield comprising a plurality of adjacent flexible shield sections disposed around the perimeter of the roof and substantially completely covering the rim space, each such shield section having a first end rigidly connected to an upper portion of the floating roof and a second end extending toward the wall of the storage tank;*

*flexible means supported from said shield for engaging the inner surface of the wall, the combination of said shield and said flexible means disposed to extend from the upper portion of the roof to the wall at an acute angle A with respect to the horizontal, and each shield section having, when unflexed, a substantially linear dimension in the direction of its intended extension from the roof toward the wall which is greater than the average rim space dimension divided by the cosine of the angle A, such that, upon installation in the tank, each shield section flexes along its linear dimension to urge said flexible means against the tank wall; and*

*vapor seal means associated with said shield sections for preventing the escape of vapors from within the tank and between the shield sections,*

*whereby the dimensioning of the shield ensures that the flexible means remains firmly pressed against the tank wall as the rim space varies so as to inhibit the release of vapors from the interior of the tank and to protect the interior of the tank from atmospheric contaminants, and said vapor seal means further inhibits the loss of vapors from the interior of the tank to the atmosphere;*

*wherein said vapor seal comprises a flexible, gas impermeable fabric covering said shield sections;*

*wherein said fabric has a light-reflective surface;*

*wherein said fabric is a continuous fabric piece covering said shield sections to inhibit the loss of vapors from within the tank between said shield sections; and* wherein said shield is inclined upwardly from the horizontal toward the wall of the tank, wherein said flexible means comprises a wiper blade having an upwardly facing top surface, a downwardly facing lower surface, and a slot between the top and bottom surfaces of the wiper blade for receiving the shield sections, and further including a plurality of resilient metal strips, one such strip fastened to the underside of each shield section and dimensioned to extend from the connection between a shield section and the roof to beyond and beneath the point where the shield section mates with the slot in said wiper blade, whereby after elevation of the roof to a point where said wiper blade extends above the wall of the tank, said resilient strips will bear on the top of the tank wall when the roof descends so as to cover the interface between the shield and the wiper blade and prevent the interface from being held by the top of the tank wall.

*16. In a storage tank having a cylindrical wall and a floating roof spaced from the wall by a rim space having a dimension between the wall and the roof which varies about an average dimension, a combined weather and vapor seal for covering the rim space, comprising:*

*a flexible shield comprising a plurality of adjacent flexible shield sections disposed around the perimeter of the roof and substantially completely covering the rim space, each such shield section having a first end rigidly connected to an upper portion of the floating roof and a second end extending toward the wall of the storage tank;*

*said shield being inclined upwardly from the horizontal toward the wall of the tank;*

*flexible means supported from said shield for engaging the inner surface of the wall, the combination of said shield and said flexible means disposed to extend from the upper portion of the roof to the wall at an acute angle A with respect to the horizontal, and each shield section having, when unflexed, a substantially linear dimension in the direction of its intended extension from the roof toward the wall which is greater than the average rim space dimension divided by the cosine of the angle A, such that, upon installation in the tank, each shield section flexes along its linear dimension to urge said flexible means against the tank wall;*

*said flexible means comprising a wiper blade having an upwardly facing top surface, a downwardly facing lower surface and a slot between the top and bottom*

*surfaces of the wiper blade for receiving said shield sections;*

*vapor seal means associated with said shield sections for preventing the escape of vapors from within the tank and between the shield sections;*

*whereby the dimensioning of said shield ensures that said flexible means remains firmly pressed against the tank wall as the rim space varies so as to inhibit the release of vapors from the interior of the tank and to protect the interior of the tank from atmospheric contaminants, and said vapor seal means further inhibits the loss of vapors from the interior of the tank to the atmosphere; and*

*a plurality of resilient metal strips fastened to the underside of said shield sections and dimensioned to extend from the connection between the shield section and the roof to beyond and beneath the point where said shield section mates with said slot in said wiper blade, whereby after elevation of the roof to a point where said wiper blade extends above the wall of the tank, said resilient strips bear on the top of the tank wall when the roof descends so as to cover an interface between said shield and said wiper blade and prevent said interface from being held by the top of the tank wall.*

* * * * *